US008786192B2

(12) United States Patent
Kadrnoschka et al.

(10) Patent No.: US 8,786,192 B2
(45) Date of Patent: Jul. 22, 2014

(54) PLASMA GENERATOR AND METHOD FOR CONTROLLING A PLASMA GENERATOR

(75) Inventors: Werner Kadrnoschka, Neudenau (DE); Rainer Killinger, Recklinghausen (DE); Ralf Kukies, Ottobrunn (DE); Hans Leiter, Oedheim (DE); Johann Mueller, Munich (DE); Georg Schulte, Neuenstadt (DE)

(73) Assignee: Astrium GmbH, Taufkirchen (DE)

( * ) Notice: Subject to any disclaimer, the term of this patent is extended or adjusted under 35 U.S.C. 154(b) by 736 days.

(21) Appl. No.: 12/991,006

(22) PCT Filed: Apr. 29, 2009

(86) PCT No.: PCT/DE2009/000615

§ 371 (c)(1),
(2), (4) Date: Oct. 3, 2011

(87) PCT Pub. No.: WO2009/135471

PCT Pub. Date: Nov. 12, 2009

(65) Prior Publication Data

US 2012/0019143 A1 Jan. 26, 2012

(30) Foreign Application Priority Data

May 5, 2008 (DE) ..... 10 2008 022 181

(51) Int. Cl.
*H01J 7/24* (2006.01)

(52) U.S. Cl.
USPC ..... 315/111.21; 315/111.41; 315/111.81; 315/111.91; 313/161; 313/231.31; 313/163; 250/423 R; 60/202

(58) Field of Classification Search
USPC ..... 315/111.21, 111.31, 111.41, 111.11
See application file for complete search history.

(56) References Cited

U.S. PATENT DOCUMENTS 3,345,820 A 10/1967 Dryden
4,104,875 A 8/1978 Birner et al.

(Continued)

FOREIGN PATENT DOCUMENTS

DE 26 33 778 A1 2/1978
DE 31 30 908 A1 3/1983

(Continued)

OTHER PUBLICATIONS

German Office Action dated Mar. 20, 2009 (Five (5) pages).

(Continued)

*Primary Examiner* — Douglas W Owens
*Assistant Examiner* — Srinivas Sathiraju
(74) *Attorney, Agent, or Firm* — Crowell & Moring LLP

(57) ABSTRACT

A plasma generator having a housing surrounding an ionization chamber, at least one working-fluid supply line leading into the ionization chamber, the ionization chamber having at least one outlet opening, at least one electric coil arrangement which surrounds at least one area of the ionization chamber, the coil arrangement being electrically connected with a high-frequency alternating-current source (AC) which is constructed such that it applies a high-frequency electric alternating current to at least one coil of the coil arrangement, is wherein a further current source (DC) is provided which is constructed such that it applies a direct voltage or an alternating voltage of a frequency lower than that of the voltage supplied by the high-frequency alternating current source (AC) to at least one coil of the coil arrangement.

14 Claims, 7 Drawing Sheets

(56) References Cited

U.S. PATENT DOCUMENTS

| | | | | |
|---|---|---|---|---|
| 4,733,134 | A * | 3/1988 | Tamura et al. | 315/111.81 |
| 4,782,235 | A * | 11/1988 | Lejeune et al. | 250/423 R |
| 5,017,835 | A * | 5/1991 | Oechsner | 315/111.81 |
| 5,417,834 | A | 5/1995 | Latz | |
| 5,947,421 | A | 9/1999 | Beattie et al. | |
| 6,001,426 | A * | 12/1999 | Witherspoon et al. | 427/449 |
| 6,195,980 | B1 | 3/2001 | Walther | |
| 6,378,290 | B1 | 4/2002 | Killinger et al. | |
| 7,513,215 | B2 * | 4/2009 | Vijayen et al. | 118/723 AN |
| 7,629,589 | B2 * | 12/2009 | Hwang et al. | 250/396 R |
| 8,158,016 | B2 * | 4/2012 | Hayes et al. | 216/59 |
| 8,400,063 | B2 * | 3/2013 | Proudfoot et al. | 315/111.71 |
| 2004/0036032 | A1 | 2/2004 | Leung et al. | |
| 2009/0145554 | A1 | 6/2009 | Weichart et al. | |

FOREIGN PATENT DOCUMENTS

| | | | |
|---|---|---|---|
| DE | 38 26 432 | C2 | 1/1989 |
| DE | 42 35 064 | A1 | 4/1994 |
| DE | 198 35 512 | C1 | 12/1999 |
| DE | 199 48 229 | C1 | 5/2001 |
| DE | 698 03 958 | T2 | 11/2002 |
| DE | 101 47 998 | A1 | 4/2003 |
| EP | 0 169 744 | A2 | 1/1986 |
| WO | WO 2008/009898 | A1 | 1/2008 |

OTHER PUBLICATIONS

International Search Report including partial English language translation dated Oct. 19, 2009 and PCT/ISA/237 Form (Fourteen (14) pages).

* cited by examiner

PLASMA GENERATOR AND METHOD FOR CONTROLLING A PLASMA GENERATOR

CROSS-REFERENCE TO RELATED APPLICATIONS

The present application is a National Stage application of PCT International Application No. PCT/DE2009/000615, filed Apr. 29, 2009, and claims priority under 35 U.S.C. §119 to German Patent Application No. 10 2008 022 181.3, filed May 5, 2008, the entire disclosures of which are herein expressly incorporated by reference.

FIELD OF THE INVENTION

The present invention relates to a plasma generator and a method of controlling a plasma generator, wherein a plasma generated in the plasma generator is controlled by using an electric or electromagnetic high-frequency alternating field.

BACKGROUND AND SUMMARY OF THE INVENTION

Plasma generators are generally known as ion sources, electron sources or plasma sources and are used as an ion source, for example, in ion engines for space engineering. The plasma generator according to the invention is a high-frequency plasma generator. When this plasma generator is used in a high-frequency ion engine, a working fluid, also called fuel or auxiliary fluid, that is introduced into the ionization chamber is ionized using an electromagnetic alternating field and is then accelerated for generating thrust in the electrostatic field of an extraction lattice system provided at an open side of the ionization chamber. The ionization takes place in the ionization chamber which is surrounded by a coil. A high-frequency alternating current flows through the coil. The alternating current generates an axial magnetic field in the interior of the ionization chamber. This magnetic field, which varies with respect to time, induces a circular electric alternating field in the ionization chamber.

This electric alternating field accelerates free electrons so that the latter can finally absorb the energy required for the electron impact ionization and atoms of the fuel are thereby ionized. The ions are either accelerated in the extraction lattice system or they recombine at the walls with electrons. The released electrons are either accelerated in the field or may themselves absorb the energy required for the ionization, or collide with the walls of the ionization chamber and recombine there.

In principle, the ionic current generated in an ion source, for impressing a defined energy, can be used for many different processes. For example, when used as an ion engine the acceleration of the ions is utilized for generating thrust according to the recoil principle.

In conventional ion sources, particularly in conventional ion engines, only a small number of ions find their way to the extraction lattice system, while the majority of the generated ions recombine on the walls of the ionization chamber. Only those ions that reach the extraction lattice system, when used as an ion engine for generating thrust or when used as a general ion source, will be available for the utilization in other processes. Of the total supplied electric power, so far, only approximately 5% to 20% of the electric power can be converted for this utilization of ions in a general ion source or in an ion engine. The remaining supplied electric power is, for the most part, converted to heat and to radiation by the recombination of the ions on the wall of the ionization chamber. A minimal ionization energy Wi is required for generating an ion. In the case of the recombination on the walls, Wi is released in the form of heat and radiation and is therefore unavailable for a further ionization or for the utilization by acceleration in the extraction lattice. The wall recombination is therefore the largest loss factor during the high-frequency ionization.

Exemplary embodiments of the present invention provide a plasma generator that reduces the power loss occurring by recombination of the ions and/or electrons on the wall of the ionization chamber.

One exemplary aspect of the present invention provides a plasma generator comprising a housing surrounding an ionization chamber, at least one working-fluid supply line leading into the ionization chamber, the ionization chamber having at least one outlet opening, and at least one electric coil arrangement surrounding at least one area of the ionization chamber. The coil arrangement is electrically connected with a high-frequency alternating-current source (AC) which is constructed such that it applies a high-frequency electric alternating current to at least one coil of the coil arrangement. A further current source is provided which is constructed such that it applies a direct current or an alternating current of a frequency lower than that of the current supplied by the high-frequency alternating current source (AC) to at least one coil of the coil arrangement.

This plasma generator reduces the power loss occurring by recombination of the ions and/or electrons on the wall of the ionization chamber.

The power loss reduction is achieved using a further current source or voltage source in addition to the known high-frequency alternating current. This current source or voltage source is designed such that a direct current or an alternating current of a frequency lower than that of the current supplied by the high-frequency alternating current source is applied to at least one coil of the coil arrangement. The direct current or alternating current of a lower frequency thereby additionally fed into the coil arrangement superposes on the magnetic high-frequency alternating field a magnetic direct field fraction or at least a fraction of a lower-frequency magnetic alternating field. Although aspects of the invention may be described using current sources is described, voltage sources may also be employed.

The Lorentz force $$F=q(v\times B)$$

wherein the charge is q, the velocity is v and the magnetic flux density is B, acts upon moving charge carriers in the magnetic field. The direct current fraction superposed on the magnetic alternating field or also the fraction of the lower-frequency alternating current superposed on the high-frequency electromagnetic alternating field has the effect that the charge carriers (electrons and ions) inside the coil and thus inside the ionization chamber are forced into orbits or spiral paths in the magnetic field. Such an orbital motion or spiral path motion of the electrons in the magnetic field reduces their movement in the direction of the wall (the so-called confinement). Since the movement of the electrons and ions from the interior of the ionization chamber to the walls and to the extraction lattice system takes place in an ambipolar manner, the flux of the ions to the walls is also correspondingly reduced. In this manner, the probability of a collision of charge carriers with the wall and thus the recombination of ions and/or electrons on the walls is clearly reduced with the plasma generator according to the invention. The ions that move in the desired direction—which, in the case of an ion engine, is the direction parallel to the longitudinal axis toward the extraction lattice system—move parallel to the magnetic lines of flux and are not hindered in their movement there by the additionally applied magnetic direct field or alternating field of a lower frequency.

The direct current, or alternating current of a lower frequency, superposed on the high-frequency alternating current flowing through the coil arrangement, is selected such that it is sufficient for obtaining a magnetic field of a desired level in the ionization chamber. The gas in the interior of the ion source, thus, in the ionization chamber, represents plasma. When an inhomogeneous magnetic field is superposed on a plasma, the plasma will move in the direction of the magnetic field that is becoming weaker (gradient drift). While the geometry of the coil arrangement is designed correspondingly, it becomes possible to move the charge carriers in the plasma as a result of gradient drift increasingly in the desired direction, for example, in the direction toward the extraction lattice system.

According to exemplary embodiments of the present invention, it becomes possible to reduce the wall losses in the ionization chamber of plasma generators, such as ion sources, particularly of ion engines, without having to change the basic design of the previously known ion sources or ion engines. In addition, the invention can be used for controlling the distribution of the plasma density in the ionization chamber. Together with the design of the ionization chamber and of the cooling arrangement, it can also be used for minimizing the wall losses. Furthermore, in the case of a plasma generator according to the present invention, the homogeneity of the plasma in the ionization chamber can be optimized when the design of the ionization chamber and of the coil arrangement is appropriate. The invention can also be used for increasing the plasma density in desired areas of the ionization chamber. It can also be used for increasing the electron flow from an electron source.

Further preferred and advantageous development characteristics of the plasma generator according to the invention are disclosed herein. The plasma generator may be constructed as a plasma source, as an electron source or as an ion source.

In one aspect of the present invention, an accelerating device for ions formed in the ionization chamber or electrons is provided in the area of the outlet opening.

When the accelerating device is an ion source, it can have an electrically positively charged lattice and a negatively charged lattice which, in the outflow direction of the ions from the ionization chamber, is situated behind the positive lattice. The accelerating device accelerates the ions forming in the ionization chamber into a direction rectangular to the plane of the lattices out of the ionization chamber and thus causes an ion ejection from the ion source. The lattices form an extraction lattice system. In the case of an electron source, the sequence of the lattices and thus the polarity will be transposed.

Such an ion source can be a component of an ion engine.

In another aspect of the present invention, an electron injector is provided in the downstream direction of the ionic current leaving the ionization chamber, which electron injector is aimed at the ionic current and is equipped for the neutralization of the ionic current. The electron injector can have a hollow cathode. Such a neutralization can prevent the ion source or the device connected with the ion source from becoming electrostatically charged.

In another aspect of the ion source according to the invention, a magnet arrangement is provided surrounding the ionization chamber.

Another aspect of the present invention involves the coil arrangement having a high-frequency coil which is connected to a high-frequency electric alternating voltage in order to introduce the high-frequency alternating current into the coil, and in the direct current generated by a direct voltage is also introduced directly into the high-frequency coil.

In this case, the feeding of the direct current can take place at a different location of the high-frequency coil than the feeding of the high-frequency alternating current.

As an alternative, the feeding of the direct current can take place into a direct-current coil arranged parallel to the high-frequency coil.

The direct current can be automatically controllable, and an automatic control device can be provided which automatically controls the direct current, for example, proportionately to the ionic current emerging from the ionization chamber.

The present invention also involves methods for controlling a plasma generator. In the case of this method, the plasma is subjected to an electromagnetic direct field in addition to the high-frequency electromagnetic alternating field. Instead of the electromagnetic direct field, the plasma can also be subjected to an electromagnetic alternating field with a lower frequency than that of the high-frequency electromagnetic alternating field.

In the following, preferred embodiments of the invention with additional further development details and further advantages will be described and explained in detail with reference to the attached drawings.

DETAILED DESCRIPTION OF THE DRAWINGS

Figure 1:
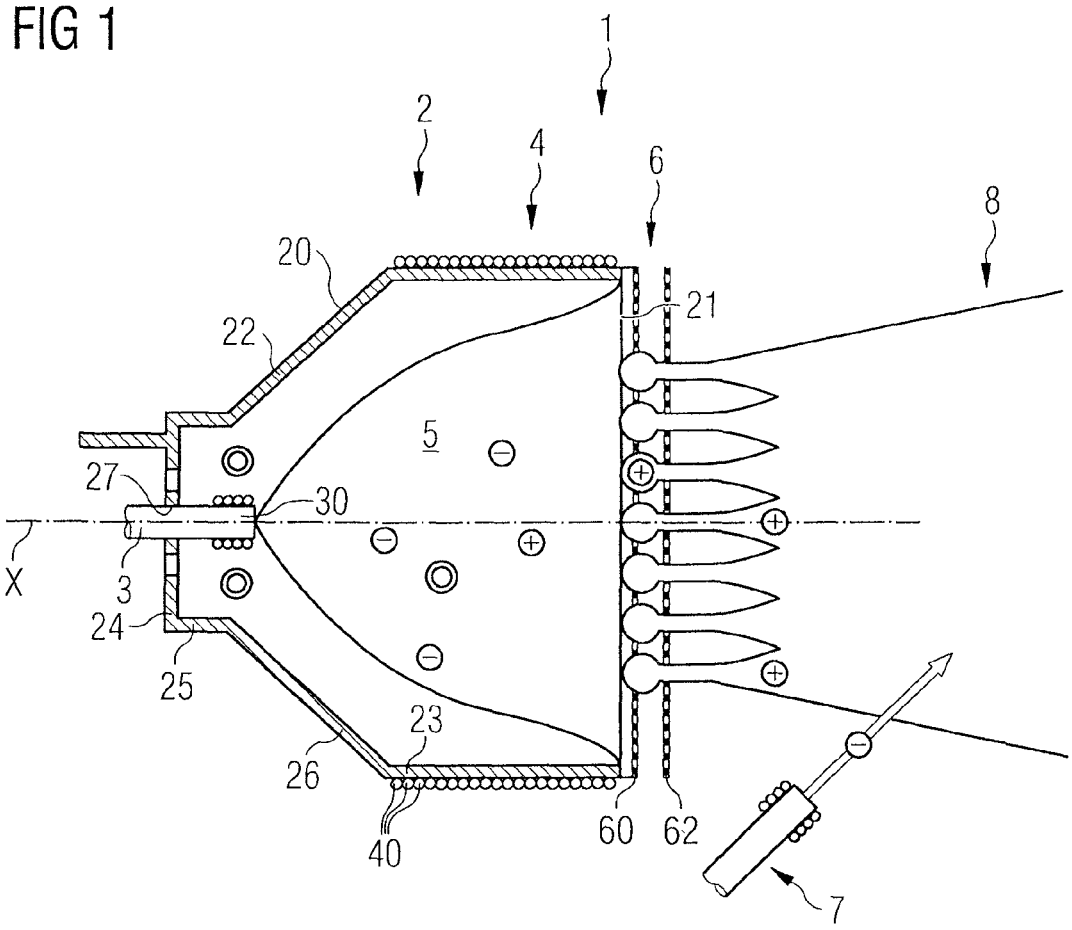
FIG. 1 is a schematic longitudinal sectional view of an ion engine.

FIG. 1 is a schematic longitudinal sectional view of an ion engine 1 with a plasma generator constructed as an ion source 2. The ion source 2 has a housing 20 made of an electrically non-conducting material and having a housing wall 22.

The housing 20 has a cup-shaped design and, on the side that is on the right in FIG. 1, is provided with an opening that forms an outlet opening 21. The housing 20 essentially has a polygonal shape or is rotation-symmetrically shaped around the longitudinal axis X. In the area of the outlet opening 21, the housing 20 forms a first cylindrical section 23 of a larger diameter. On the side facing away from the outlet opening 21 in the direction of the axis X, a housing bottom 24 is provided that extends at a right angle with respect to the axis X. The outside diameter of the housing bottom 24 is smaller than the diameter of the first cylindrical housing section 23. The housing bottom 24 is adjoined by a second cylindrical housing section 25 whose diameter is also smaller than that of the first cylindrical housing section 23. The two cylindrical housing sections 23 and 25 are mutually connected by way of a truncated-cone-shaped housing section 26. The housing 20 may also have different shapes in the longitudinal sectional view; for example, a conical, cylindrical or semi-elliptic shape.

In the area of the axis X, the housing bottom 24 has a central opening 27 and a pipe 3 extending from the outside in the axial direction through this opening 27. The pipe 3 opens up in the interior of the housing 20 of the ion source 2. Outside the ion source 2, the pipe 3 is connected with a source for a working fluid (not illustrated) such that the working fluid can be introduced using a delivery device (not illustrated) through the pipe 3 into the interior of the ion source 2. The pipe 3 therefore forms a working-fluid supply line 30 for the ion source.

In its first cylindrical section 23, the housing 20 of the ion source 2 is surrounded by windings 40 of an electric coil arrangement 4.

An ionization chamber 5 is thereby formed in the interior of the housing 20 of the ion sources 2 constructed as described above. In front of the outlet opening 21 of the housing 20, an extraction lattice arrangement 6 is provided which has an electrically positively charged lattice 60 facing the outlet opening 21 and an electrically negatively charged lattice 62 facing away from the outlet opening 21. As will be described below, during the operation of the ion source 2, ions can exit through the extraction lattice arrangement 6 to the outside parallel to the axis X (to the right in FIG. 1) as ionic current 8.

Outside the housing 20 of the ion source 2, an electron injector 7 is provided in the proximity of the outlet opening 21 and of the extraction lattice 6. The electron injector 7 is constructed as a hollow cathode and is connected to a working fluid supply. Using the electron injector 7, electrons can be injected into the ionic current 8 exiting from the ion source 2 in order to thereby electrically neutralize the ionic current 8.

During the operation of the ion source 2, a working fluid, such as xenon gas, is introduced through the working-fluid supply line 30 into the ionization chamber 5 of the ion source 2. By the application of a high-frequency electric alternating voltage to a high-frequency coil of the coil arrangement 4, plasma is generated inside the ionization chamber 5 in that electrons are caused to collide with atoms in order to generate ions. The ions which, as a result of the electric alternating field applied using the coil 4, migrate parallel to the longitudinal axis X in the direction of the outlet opening 21, are accelerated in the extraction lattice arrangement 6 and exit as an ion current 8 at a high velocity from the ion source 2, whereby a thrust force acts upon the ion source 2 as a recoil force.

The gas in the interior of the housing 20 of the ion source 2,—thus, in the ionization chamber 5—represents a plasma. When a non-homogeneous magnetic field is superposed on the plasma, the plasma will move in the direction of the magnetic field that is becoming weaker, which is called a "gradient drift". Using a suitable design of the coil geometry of the coils in the coil arrangement 4, it becomes possible, as a result of the gradient drift, to move the charge carriers in the plasma increasingly in the direction toward the outlet opening 21, thus, toward the extraction lattice arrangement 6.

For this purpose, a high-frequency alternating current is fed into a high-frequency coil of the coil arrangement 4. In addition, in the case of this ion source, a direct current is fed into a resonant circuit which has the high-frequency coil and a high-frequency generator as an alternating-current source. The amount of direct current is controlled by corresponding control devices of an assigned direct-current source. The circuit containing the direct-current source is shielded from high-frequency fractions using suitable filters. In a known manner, such filters are formed by a network consisting of at least one coil and at least one capacitor. As an alternative, it is also possible to use a generator which supplies a direct-current fraction in addition to the alternating current.

Figure 2:
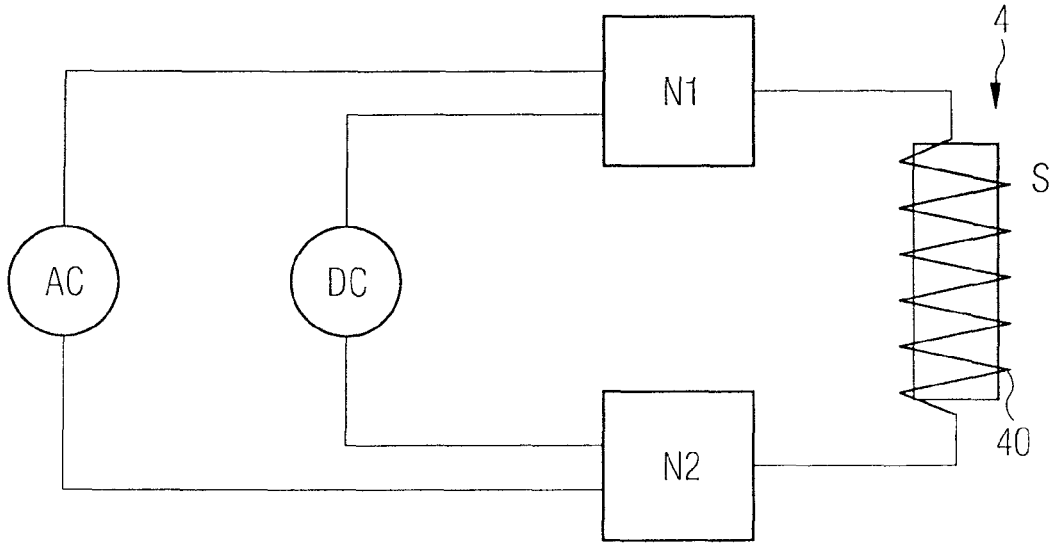
FIG. 2 is an electric circuit diagram of the power supply of a plasma generator constructed as an ion source according to a first embodiment of the present invention.

FIG. 2 is a circuit diagram of the electric coil arrangement 4 here marked by the reference symbol "S" as well as of a high-frequency alternating-current source AC and of a direct-current source DC. Furthermore, two networks N1 and N2 are provided in the circuit at the input and at the output of the coil winding 40. A current I, which has a periodically alternating current fraction generated by the high-frequency alternating-current source AC and a direct-current fraction or slightly varying fraction which is generated by the direct-current source DC, flows through the coil of the coil arrangement S. The alternating-current source AC has a generator, which supplies the alternating-current fraction, and the direct-current source DC is further developed to have a modulation capacity and generates the constant or slightly variable fraction of the current I flowing through the coil. The networks N1 and N2 block the direct-voltage fractions with respect to the alternating-current source AC and the alternating-voltage fractions with respect to the direct-current source DC. For this purpose, corresponding R-, C- or L-networks can be used in networks N1 and N2.

Figure 3:
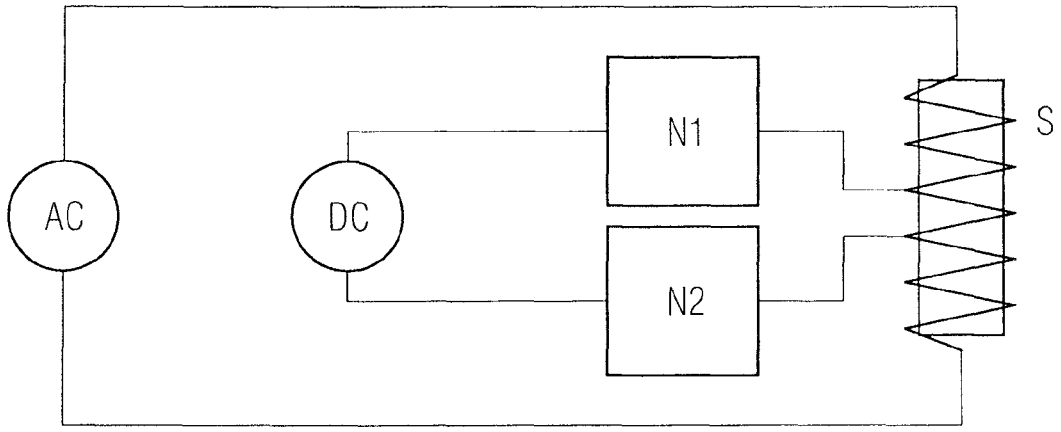
FIG. 3 is an electric circuit diagram of the power supply of a plasma generator constructed as an ion source according to a second embodiment of the present invention.

As an alternative to the circuit of FIG. 2, according to the representation of FIG. 3, the constant or slightly variable current cannot be impressed on the entire coil winding but only on individual windings or a part of the total coil winding, which in this case do not have to be complete windings.

Figure 4:
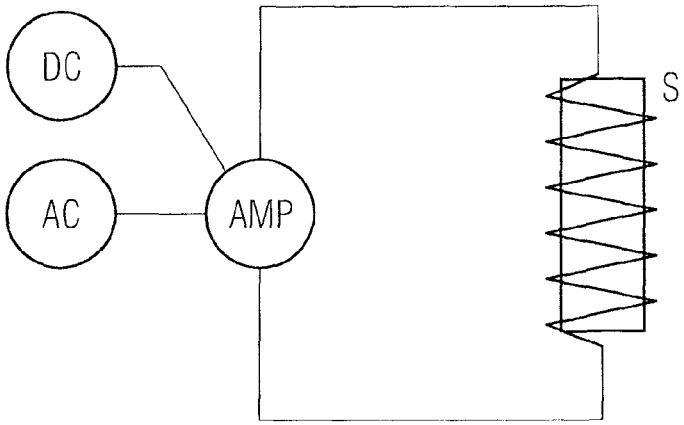
FIG. 4 is an electric circuit diagram of the power supply of a plasma generator constructed as an ion source according to a third embodiment of the present invention.

In the alternative embodiment illustrated in FIG. 4, an amplifier AMP is provided for generating the coil current, the amplifier being controlled by an alternating-current generator (alternating-current source AC) for the periodic signal (alternating-current fraction of current I) and a direct-current generator (direct-current source DC) for the constant or slightly variable fraction of current I. The amplifier AMP may be a so-called Class A or Class AB amplifier.

Figure 5:
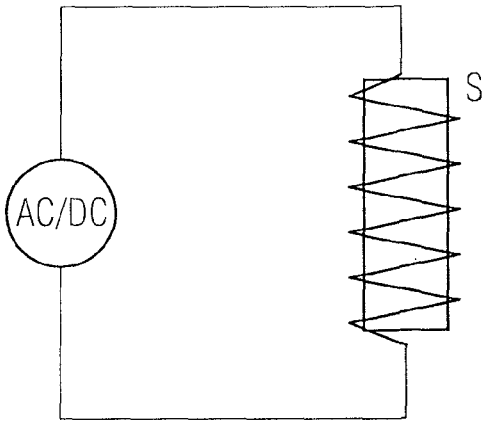
FIG. 5 is an electric circuit diagram of the power supply of a plasma generator constructed as an ion source according to a fourth embodiment of the present invention.

Another alternative embodiment is illustrated in FIG. 5. In the case of this embodiment, the coil of the coil arrangement S is controlled by a generator ACDC whose direct current fraction is not blocked off with respect to the alternating current fraction. Ideally, the direct-current fraction is controllable or automatically controllable.

Figure 6:
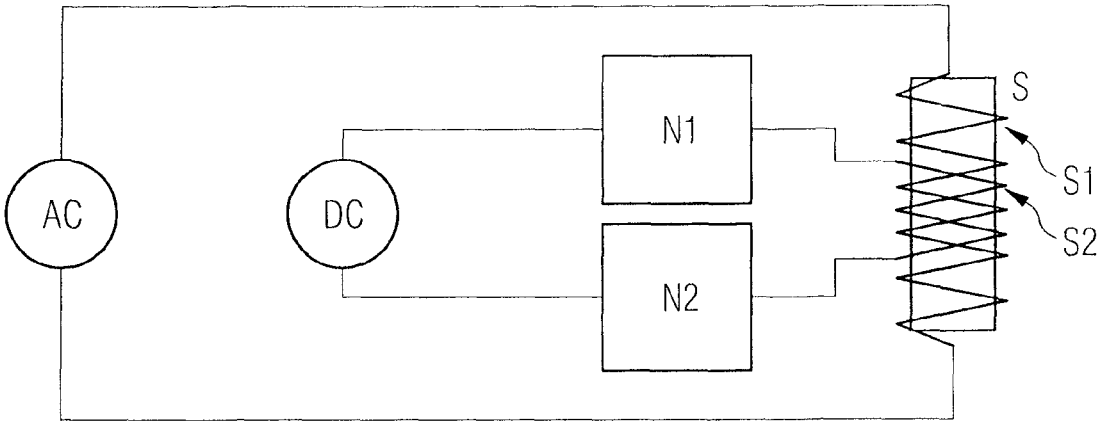
FIG. 6 is an electric circuit diagram of the power supply of a plasma generator constructed as an ion source according to a fifth embodiment of the present invention.

In the further alternative embodiment illustrated in FIG. 6, the coil arrangement S has a separate coil S2 in addition to the coil S1 connected with the high-frequency alternating-current source AC, which separate coil S2 is supplied by the direct-current source DC with direct current or a slightly variable current. In this case, the direct-current source DC is protected using the networks N1 and N2 provided at the input and at the output of coil S2 against a current induced by coil S1 of the alternating-current circuit. Instead of a single coil in the alternating-current circuit, several oils may also be provided. Likewise, several coils may also be provided instead of a single coil S2 in the direct-current circuit.

Figure 7A:
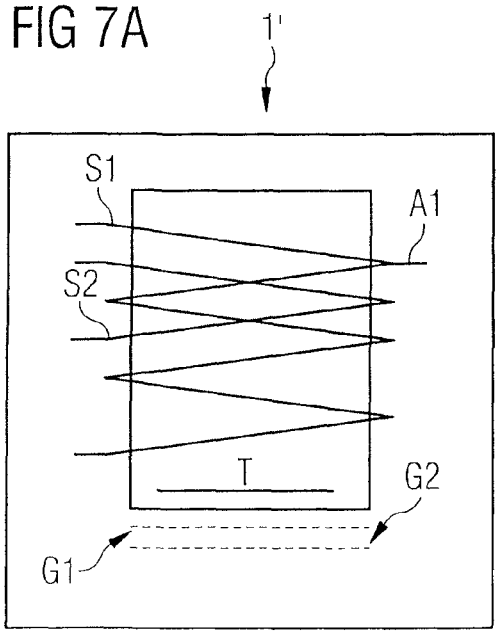
FIG. 7A is a schematic circuit diagram of a coil arrangement for a plasma generator according to the invention as an electron source or ion source with an external coil.
Figure 7B:
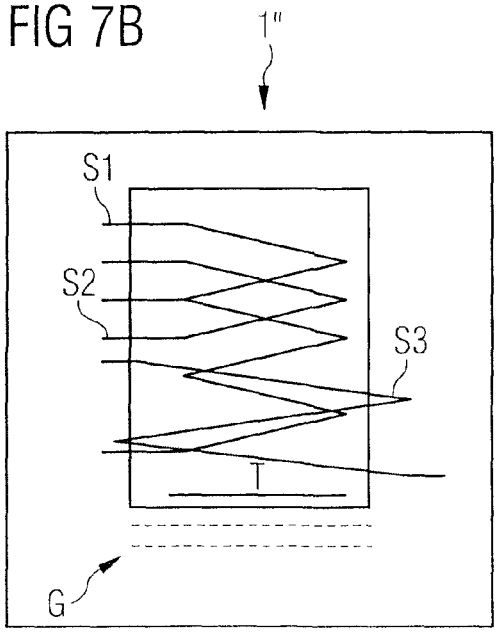
FIG. 7B is a schematic circuit diagram of a coil arrangement for a plasma generator according to the invention as an electron source or ion source with an internal coil.

For the superposing of the high-frequency alternating current in the coil arrangement S by a direct current or a slightly variable current (alternating current of a lower frequency), the ion source 1' can be an ion source with an external coil or with external coils, as schematically illustrated in FIG. 7. However, as illustrated in FIG. 8, the ion source 1" may also be constructed with one or several internal coil(s). The embodiment of the ion source 1' in FIG. 7 is equipped with two coils S1 and S2, coil S1 having a tap A1 at which a superposed current can be fed partially into coil S1. In addition to the coil arrangement S, FIG. 7 also shows an extraction lattice arrangement G.

In FIG. 8, also two coils S1 and S2 and, in addition a third coil S3 are provided. The ion source 1" schematically illustrated in FIG. 8 is also equipped with an extraction lattice arrangement G.

The plasma generators schematically illustrated in FIGS. 7 and 8 can be used in ion engines having an extraction lattice arrangement in which the first lattice G1 adjacent to the ionization chamber is positively charged and the second lattice G2 is negatively charged, in electron sources having an extraction lattice arrangement in which the first lattice G1 adjacent to the ionization chamber is negatively charged and the second lattice G2 is positively charged, in electron sources without any extraction lattice arrangement or in electron sources that emit by way of a plasma bridge. In principle, substrates T can also be placed in the ionization chamber.

Figure 8A:
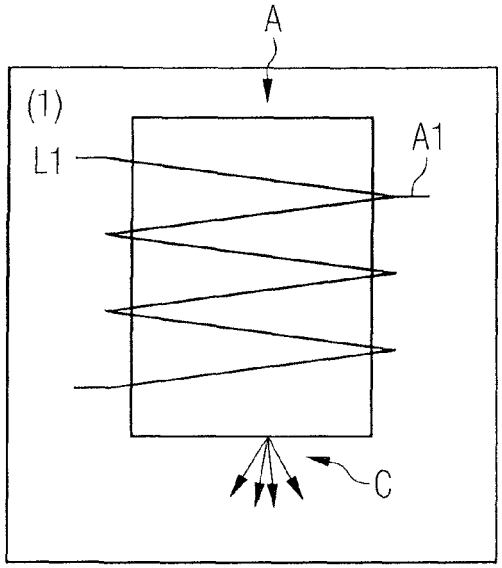
FIG. 8A is a schematic view of a plasma generator according to the invention as a plasma source.

The illustrated plasma generators can also be used in a plasma source into which a working gas A is introduced and from which a mixture C of ions, electrons and neutral particles (plasma) emerges, as symbolically shown in FIG. 8A. A plasma bridge may also be formed at the outlet for the mixture C. The plasma can also emerge at a higher pressure and form a plasma jet.

Figure 8B:
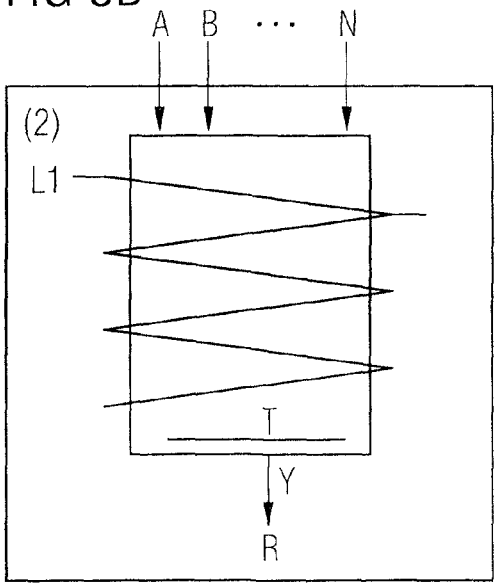
FIG. 8B is a schematic view of a plasma generator according to the invention as a plasma source for carrying out plasma-chemical processes.

As symbolically illustrated in FIG. 8B, several working gases A, B, . . . N can also be introduced into the plasma generator. Plasma-chemical processes will then take place in the ionization chamber, so that a desired reaction product R can be removed at a suitable location Y of the plasma generator or can interact directly with a substrate T provided in the plasma source.

Figure 9:
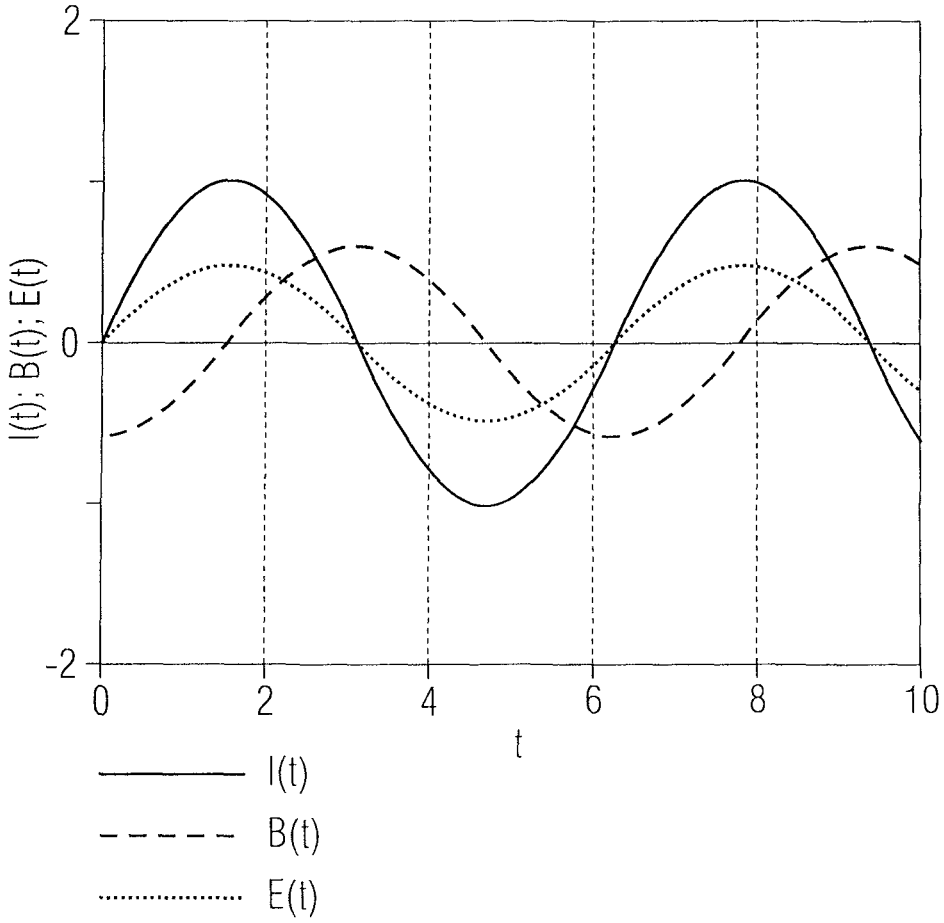
FIG. 9 is a diagram concerning the time behavior of the coil current, of the induced magnetic flux and of the electric field in the case of a plasma generator according to the invention.
Figure 10:
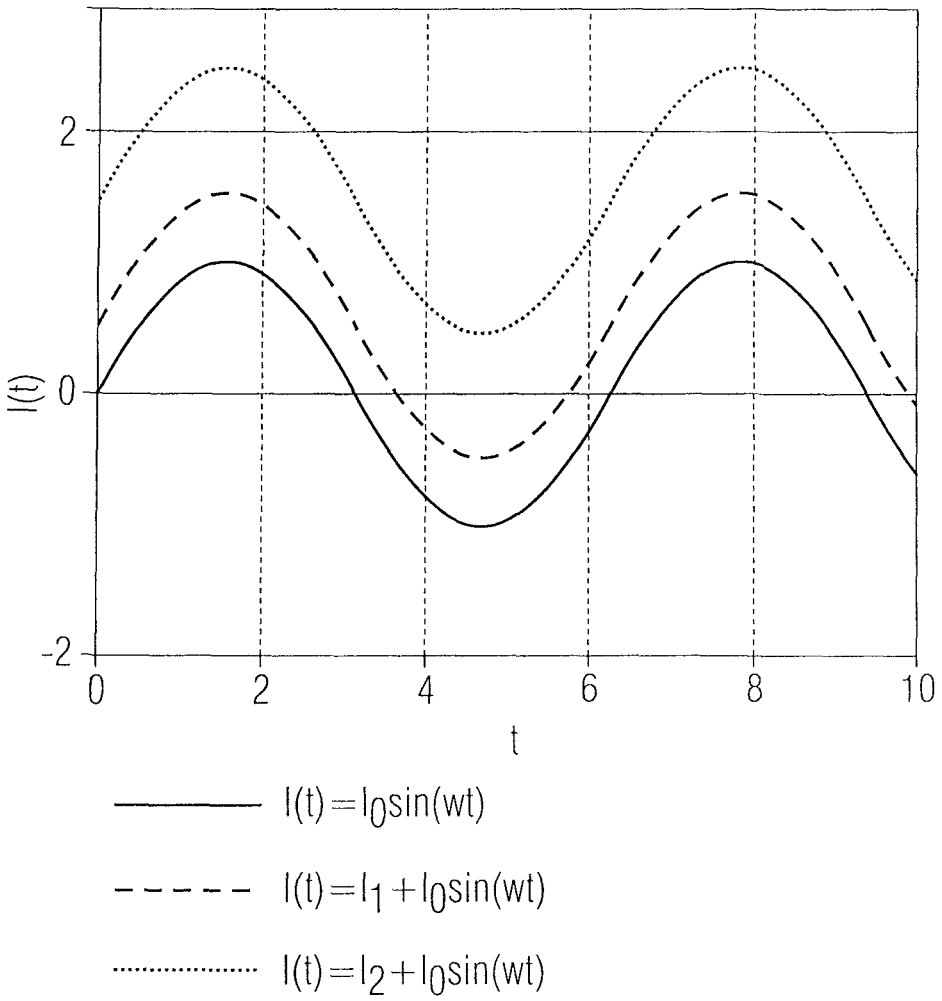
FIG. 10 is a diagram concerning the coil current in the case of a direct-current superposition.
Figure 11:
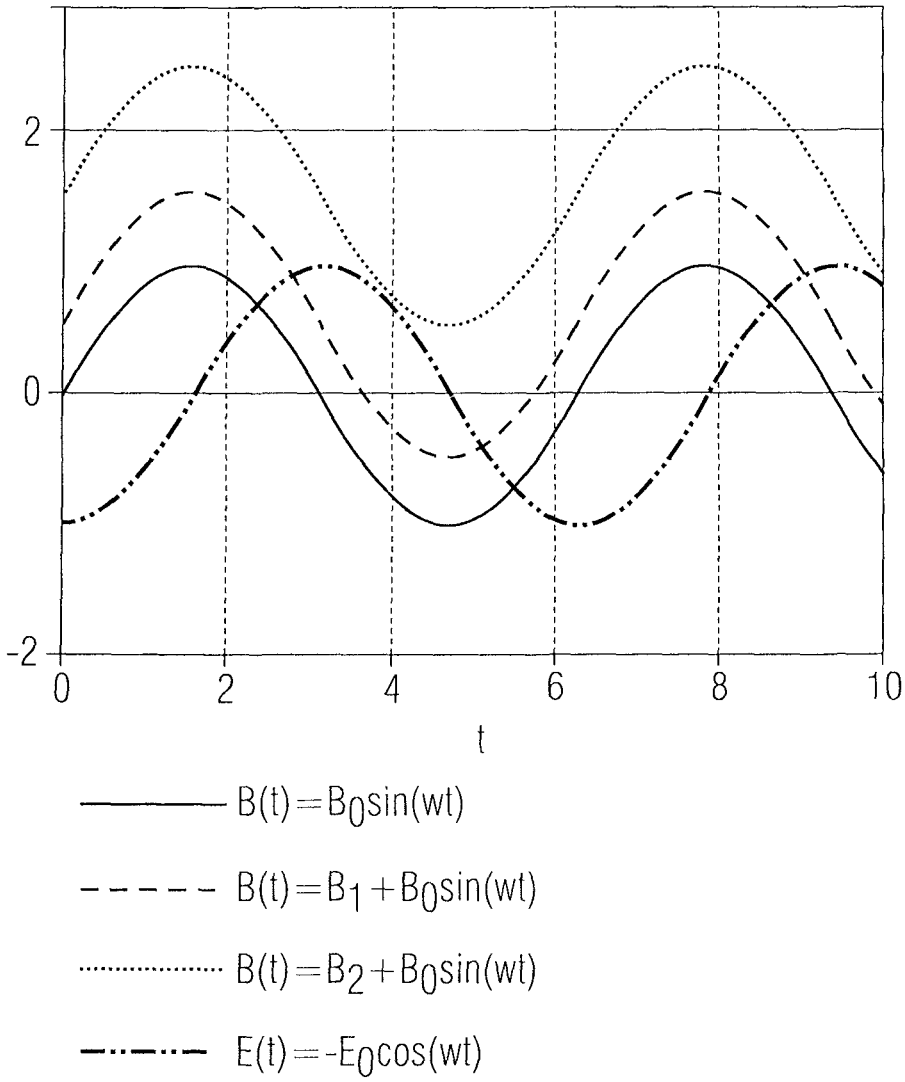
FIG. 11 is a view of the magnetic flux induced by the coil current when a direct-current fraction is impressed.

FIGS. 9 to 11 are diagrammatic representations of the time variation of the current I(t), of the magnetic flux density B(t) and of the induced electric field intensity E(t) using a sine function. The representation as a sine function is only an example; any periodic function is conceivable.

FIG. 9 illustrates the time rate of change of the current I(t) flowing through the alternating-current coil of the coil arrangement 4 as well as the thereby induced magnetic flux B(t) and of the electric field E(t) applied to the plasma generator. In this case, the course of the current I(t) is drawn as a solid line; the time behavior of the magnetic flux density (B(t) is drawn as a pointed line, and the course of the electric field intensity (E(t) is drawn as a dash-dotted line. In the representation of FIG. 9, no additional impressing of a direct current has yet taken place.

FIG. 10 illustrates three current courses, where a lower direct current $I_1$ and alternatively, a higher direct current $I_2$ is impressed on the alternating current $I(t)=I_0 \sin(wt)$ flowing through the coil. As a result, the curve of the time behavior of the alternating current is displaced toward the positive range of the current or completely into the positive range of the current. Instead of the direct current, a slightly variable current, thus a direct current of a lower frequency than the high-frequency alternating current I(t) can be impressed on the alternating current. The impressing of the direct current or of the slightly variable current can take place either for the entire coil or only for some of the windings of the coil.

FIG. 11 illustrates the magnetic flux resulting from the course of the current according to the three examples of FIG. 10. It is demonstrated that here also, using the impression of the direct-current fraction $I_1$, the magnetic flux $B(t)=B_0 \sin(wt)$ is displaced in a parallel manner by a constant magnetic flux $B_1$ toward the positive range. In the same fashion, a parallel displacement completely into the positive range takes place in the case of the third curve of the example because of the fact that, as a result of the impressed larger direct-current fraction $I_2$, a correspondingly high magnetic flux $B_2$ is impressed on the magnetic alternating field $B_0 \sin(wt)$. The superposed uniform current fraction thereby results in an additional magnetic flux. As illustrated in the representations of FIGS. 10 and 11, the ratio of time periods with a negative flux direction to a positive flux direction can be influenced by the corresponding selection of the amount of additionally fed direct current, and a sign reversal of the magnetic flux can thereby be suppressed. Likewise, it becomes possible to generate a flux density that is high in comparison to the amplitude of the periodic flux change. Furthermore, this flux density can be adapted in a targeted manner to plasma conditions (ECR and ICR resonance frequency). The induced electric field E(t) remains uninfluenced by the additional impressing of a direct current and the resulting additional impressing of a constant magnetic flux.

The present invention therefore superpositions the alternating current in the high-frequency coil of the coil arrangement 4 of a plasma generator, such as an electron source, a plasma source, an ion source or an ion engine. As a result, the wall losses are reduced by the magnetic inclusion of the electrons in the ionization chamber. This inclusion of electrons in the ionization chamber may also take place in a time-controlled manner. In addition, the magnetic inclusion of the electrons in the ionization chamber may take place for checking or controlling the plasma density distribution in the ionization chamber. Here also, the magnetic inclusion can be carried out in a time-controlled manner in order to control the plasma density distribution as a function of the time.

The feeding of the high-frequency alternating current or of the direct current may take place directly into the high-frequency alternating-current coil of the coil arrangement 4, so that the alternating current and the direct current are fed into the same coil. The high-frequency coil may be constructed in one or two layers. It may be constructed with a center tapping or partial tapping(s) for the two-sided grounding of the connections, the windings being wound in opposite directions. The feeding of the direct current can take place by way of one tapping, so that the direct current is introduced into the coil only by way of some of the windings.

As an alternative, instead of being fed into the high-frequency coil, the direct current can be fed into a coil of a bifilar arrangement, which coil is situated in a suitable manner parallel to the high-frequency coil. The direct-current coil may have the same, a smaller or a higher number of windings than the high-frequency coil. The high-frequency coil may have one or more feeding points. In this case, the feeding of the direct current may take place from one or more direct-current sources. In the case of several direct-current sources, the latter supply either a current of the same intensity or currents of different intensities through the coil or the windings.

The entire coil arrangement can be designed such that the feeding of the high-frequency alternating current and the feeding of the direct current do not influence one another. The high-frequency alternating current can be fed using an automatic PLL phase control. The high-frequency alternating-current coil may be part of a series resonant circuit or of a parallel resonant circuit.

The high-frequency coil and/or the direct-current coil can be arranged either outside or inside the housing 20 of the plasma generator. The housing of the plasma generator can be further developed as a cylinder, a cone or another shape.

For an optimal distribution of the magnetic field, the coil may also have any shape other than a cylindrical design. Thus, for example, the pitch of the windings may be non-uniform. The windings may also be arranged at different distances from one another. The winding can, for example, be meandrous. Using the coil, a cusp field or a multipolar field can be generated. By way of a plurality of feeding points distributed along the high-frequency coil, an arbitrary distribution of the magnetic field can also be achieved.

For an optimal adaptation of the magnetic field, the direct current can be controllable or automatically controllable. For example, in the case of an ion source or an ion engine, corresponding to the exiting ion current which, in the case of an ion engine, is proportional to the thrust.

Reference numbers in the claims, in the description and in the drawings only have the purpose of better explaining the invention and are not meant to limit the scope of protection.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

LIST OF REFERENCE NUMBERS

1 Ion Engine
2 Ion Source
3 Pipe
4 Electric Coil Arrangement
5 Ionization Chamber
6 Extraction Lattice Arrangement
7 Electron Injector
8 Ion Current
20 Housing
21 Outlet Opening
22 Housing Wall
23 First Cylindrical Housing Section
24 Housing Bottom
25 Second Cylindrical Housing Section
26 Truncated-Cone-Shaped Housing Section
27 Central Opening
28 Insulation Section
30 Working-Fluid Supply Line
40 Windings
60 Electrically Positively Charged Lattice
62 Electrically Negatively Charge Lattice

The invention claimed is:

1. A plasma generator comprising:
a housing surrounding an ionization chamber,
at least one working-fluid supply line leading into the ionization chamber, the ionization chamber having at least one outlet opening,
at least one electric coil arrangement surrounding at least one area of the ionization chamber,
wherein the coil arrangement is electrically connected with a high-frequency alternating-current source which is constructed such that it applies a high-frequency electric alternating current to at least one coil of the coil arrangement,
wherein a further current source is provided which is constructed such that it applies, to at least one coil of the coil arrangement that is axially aligned with the at least one coil of the coil arrangement to which the high-frequency electric alternating current is applied, a direct current or an alternating current of a frequency lower than that of the current supplied by the high-frequency alternating current source.

2. The plasma generator according to claim 1, wherein the plasma generator is an ion source.

3. The plasma generator according to claim 2, wherein an accelerating device for ions formed in the ionization chamber is in an area of the outlet opening.

4. A plasma generator comprising:
a housing surrounding an ionization chamber,
at least one working-fluid supply line leading into the ionization chamber, the ionization chamber having at least one outlet opening,
at least one electric coil arrangement surrounding at least one area of the ionization chamber,
wherein the coil arrangement is electrically connected with a high-frequency alternating-current source which is constructed such that it applies a high-frequency electric alternating current to at least one coil of the coil arrangement,
wherein a further current source is provided which is constructed such that it applies a direct current or an alternating current of a frequency lower than that of the current supplied by the high-frequency alternating current source to at least one coil of the coil arrangement,
wherein the plasma generator is an ion source,
wherein the ion source is an ion engine,
wherein an accelerating device for ions formed in the ionization chamber is in an area of the outlet opening, and
wherein the accelerating device has an electrically positively charged lattice and a negatively charged lattice situated behind the positive lattice in the outflow direction of the ions from the ionization chamber.

5. The plasma generator according to claim 3, wherein the ion source is an ion engine.

6. The plasma generator according to claim 5, wherein an electron injector is provided in the downstream direction of the ion current leaving the ionization chamber, the ion injector is aimed at the ion current and is set up for neutralizing the ion current, the electron injector having a hollow cathode.

7. The plasma generator according to claim 1, wherein a magnet arrangement is provided which surrounds the ionization chamber.

8. The plasma generator according to claim 1, wherein the coil arrangement has a high-frequency coil which is connected to a high-frequency electric alternating voltage in order to introduce the high-frequency alternating current into the coil, and wherein the direct current generated by a direct voltage is also introduced directly into the high-frequency coil.

9. The plasma generator according to claim 8, wherein feeding of the direct current takes place at a different location of the high-frequency coil than feeding of the high-frequency alternating current.

10. The plasma generator according to claim 8, wherein the direct current is fed into a direct-current coil arranged parallel to the high-frequency coil.

11. A method of controlling a plasma generator, comprising:

generating, by the plasma generator, plasma;

applying a high-frequency electric alternating current to at least one coil of a coil arrangement surrounding at least one area of an ionization chamber, applying, to at least one coil of the coil arrangement that is axially aligned with the at least one coil of the coil arrangement to which the high-frequency electric alternating current is applied, a direct current or an alternating current of a frequency lower than that of the current supplied by the high-frequency alternating current source.

12. The method of claim 11, wherein the plasma generator is an ion source.

13. The method of claim 12, wherein the ion source is an ion engine.

14. The method of claim 13, further comprising:

applying an electrically positive charge to a first lattice located in an outlet opening of the plasma generator; and applying a electrically negative charge to a second lattice situated behind the first lattice in an outflow direction of ions from an ionization chamber of the plasma generator.

* * * * *